US006827300B2

(12) United States Patent
Lee

(10) Patent No.: US 6,827,300 B2
(45) Date of Patent: Dec. 7, 2004

(54) AUTOMATIC START MECHANISM OF SHREDDING APPARATUS

(75) Inventor: Pei-Yuan Lee, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 403 days.

(21) Appl. No.: 10/010,182

(22) Filed: Nov. 6, 2001

(65) Prior Publication Data

US 2003/0019964 A1 Jan. 30, 2003

(30) Foreign Application Priority Data

Jul. 24, 2001 (TW) ..... 90118095 A

(51) Int. Cl.[7] ..... B02C 25/00
(52) U.S. Cl. ..... 241/36; 241/236
(58) Field of Search ..... 241/36, 34, 100, 241/236

(56) References Cited

U.S. PATENT DOCUMENTS 5,167,374 A * 12/1992 Strohmeyer ..... 241/36
5,984,215 A 11/1999 Huang ..... 241/36
6,308,904 B1 * 10/2001 Chang ..... 241/36

* cited by examiner

*Primary Examiner*—Mark Rosenbaum
(74) *Attorney, Agent, or Firm*—Haverstock & Owens LLP

(57) ABSTRACT

An automatic start mechanism for a shredding apparatus is disclosed. The shredding apparatus includes a shredding mechanism for cutting the paper when the paper passes through a channel, a power source for outputting a motive power for the shredding mechanism, a trigger disposed at an entrance of the channel for arising a move when the paper passing through the channel to be against thereto, a delay unit for producing an against force driven by the power source, a lever connected between the trigger and the delay unit for moving in response to the trigger and the delay unit against, and a switch electrically connected to the power source and contacted to a first portion of the lever. The distance between the first portion of the lever and the trigger is smaller than a distance between the delay unit and the trigger.

7 Claims, 4 Drawing Sheets

AUTOMATIC START MECHANISM OF SHREDDING APPARATUS

FIELD OF THE INVENTION

The present invention relates to a shredding apparatus, and more particularly to an automatically starting shredding apparatus.

BACKGROUND OF THE INVENTION

A shredding machine is an essential machine in an office. Generally, two types of shredding apparatus are used. The first type results in elongated shredded paper, and the second type results in even smaller segmental shredded paper. FIG. 1 is a schematic top plane view of the first type of shredding apparatus. When paper to be shredded enters a channel 20, a trigger 22 disposed in the channel 20 in space between two cutters 211 is actuated to start the shredding operation, as described in U.S. Pat. No. 5,984,215. On the other hand, for the second type of shredding apparatus as shown in FIG. 2, the space between the two cutters 311 are filled with a spacer 32. In other words, there is no vacancy between the cutters 311 for the disposition of the trigger. Therefore, the trigger of the second type of shredding apparatus has to be arranged above the cutters in the channel.

FIG. 3 is a perspective diagram illustrating partial structures of a conventional shredding machine having an automatic paper-shredding start mechanism. As shown in FIG. 1, the shredding machine includes a first and second series of cutters 111 which are sleeved on a first shaft 11 and a second shaft 11', respectively, a trigger 12, a carrying bar 13, an elastic plate 14, a gear set 15, a delay cam 151, a switch 16 and a motor 17. When paper passes through a channel 10 formed between the first and second shafts 11, 11' and is cut by the cutters 111, the trigger 12 is simultaneously pushed by the paper and further carries the carrying bar 13 to rotate. Thus, a portion 131 of the carrying bar 13 is under a lifting position for being against the elastic plate 14 to turn on the switch 16, which starts the motor 17. Further, the first and second shafts 11, 11' are driven to rotate by the motor 17 and enables the cutters 111 to cut the paper. The gear set 15 and the delay cam 151 are also driven to rotate by the motor 17. Thus, when the whole paper passes through the trigger 12 causing the trigger 12 not to be against by the paper, and not to further keep the portion 131 of the carrying bar 13 at the lifting position, the existence of the delay cam 151 allows the carrying bar to remain continuously against the elastic plate 14 for a while so as to keep the switch 16 on. Thus, the motor 17 can continuously operate for a delay time to assure that the paper is fully cut before the motor 17 stops.

For this automatic start mechanism, a long carrying bar is used for power transmission from the trigger to the switch via the elastic plate. As known, the carrying bar, once deformed, cannot lift the elastic plate normally to conduct the switch when paper is passing through the channel. Thus, the automatic start paper shredding function is invalid.

Therefore, the purpose of the present invention is to develop a shredding apparatus having an improved automatic start mechanism to deal with the above situations encountered in the prior art.

SUMMARY OF THE INVENTION

It is therefore an object of the present invention to provide a shredding apparatus which has a relatively small power transmission distance between the trigger and the switch so as to minimize the deformation effect of the carrying bar on the conduction of the switch.

According to an aspect of the present invention, there is provided a shredding apparatus having an automatic start mechanism. The shredding apparatus includes a channel for a paper to enter the shredding apparatus, a shredding mechanism for cutting the paper when the paper passes through the channel, a power source for providing a motive power for the shredding mechanism, a trigger disposed in the channel for arising a move in response to a sustaining force of the paper against the trigger, a delay unit driven by the power source for delaying the sustaining force for a particular time, a lever connected between the trigger and the delay unit and transmitted by the trigger and the delay unit, and a switch electrically connected to the power source and optionally connected to a first portion of the lever depending on a moving status of the lever to be switched between an ON condition and an OFF condition, wherein a distance between the first portion of the lever and the trigger is smaller than a distance between the delay unit and the trigger.

For example, the power source is an electric motor.

Preferably, the shredding mechanism includes a first shaft carried to rotate by the power source, a second shaft disposed with the first shaft in parallel and carried to rotate by the power source, a plurality of cutters staggeredly sleeved and fixed on the first and second shafts and transmitted to rotate by the first and second shaft, respectively, for cutting the paper when the paper passes through the channel, wherein a space is existent between every two adjacent cutters on the same shaft, and a plurality of guiding plates, each of which is disposed in one the space, and movably sleeved on one of the first and the second shafts.

Preferably, the channel includes an entrance end for putting the paper thereinto. The trigger preferably includes a protruding element fixed on the lever, disposed at the entrance of the channel, and against by the paper when the paper passes through the channel to carry the lever to rotate.

Preferably, the delay unit includes a delay gear set connected to the power source and carried by the power source to rotate, and a delay cam connected to the delay gear set and the lever and carried by the delay gear set to rotate for delaying the sustaining force for the particular time.

Preferably, the first portion of the lever is a protrusion optionally connected with the switch for switching the switch between the ON condition and OFF condition depending on a connection status between the protrusion and the switch.

The present invention may best be understood through the following description with reference to the accompanying drawings, in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
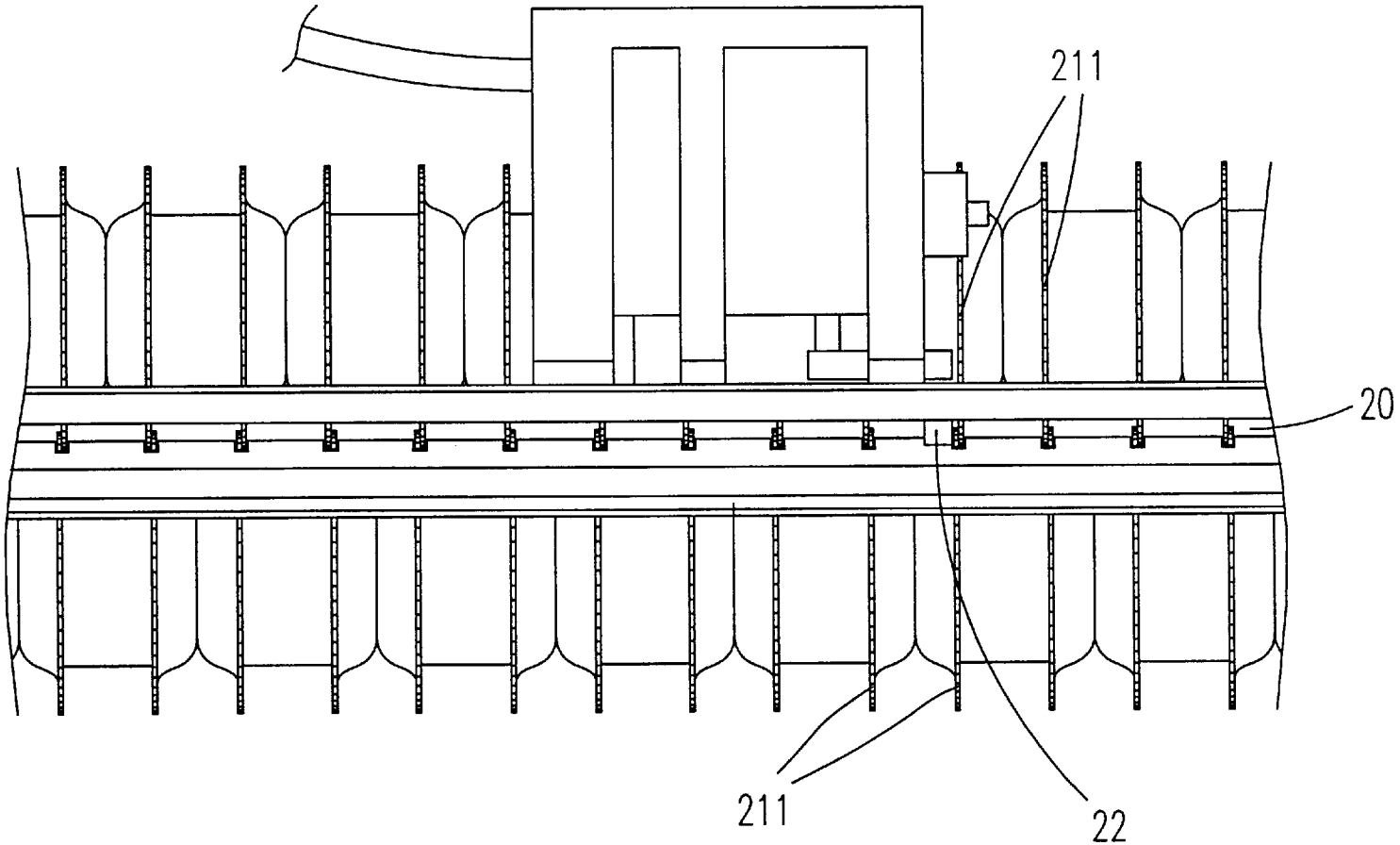
Fig. 1 PRIOR ART
FIG. 1 is a top view illustrating partial structures of a type of conventional shredding machine.
Figure 2:
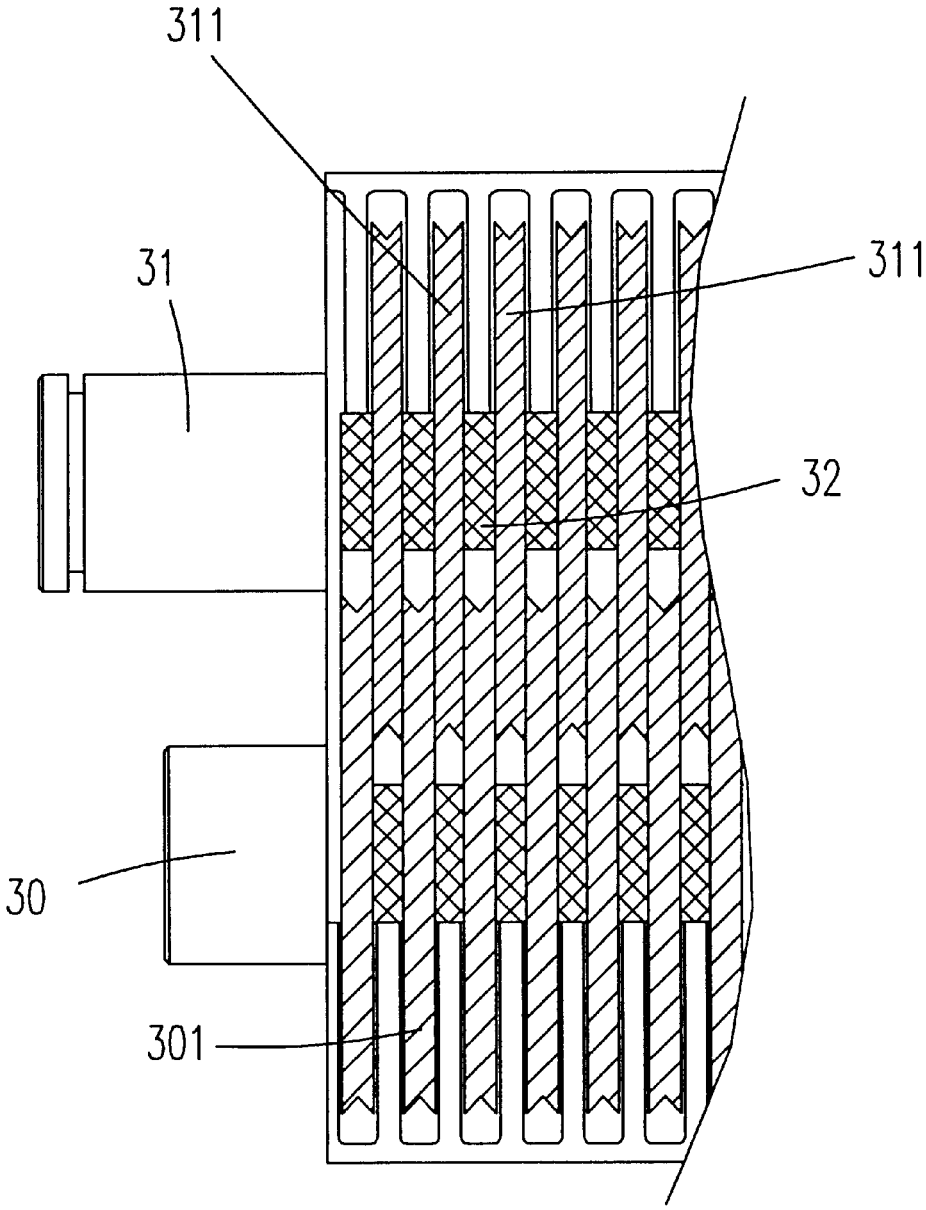
Fig. 2 PRIOR ART
FIG. 2 is a top view illustrating partial structures of another type of conventional shredding machine.
Figure 3:
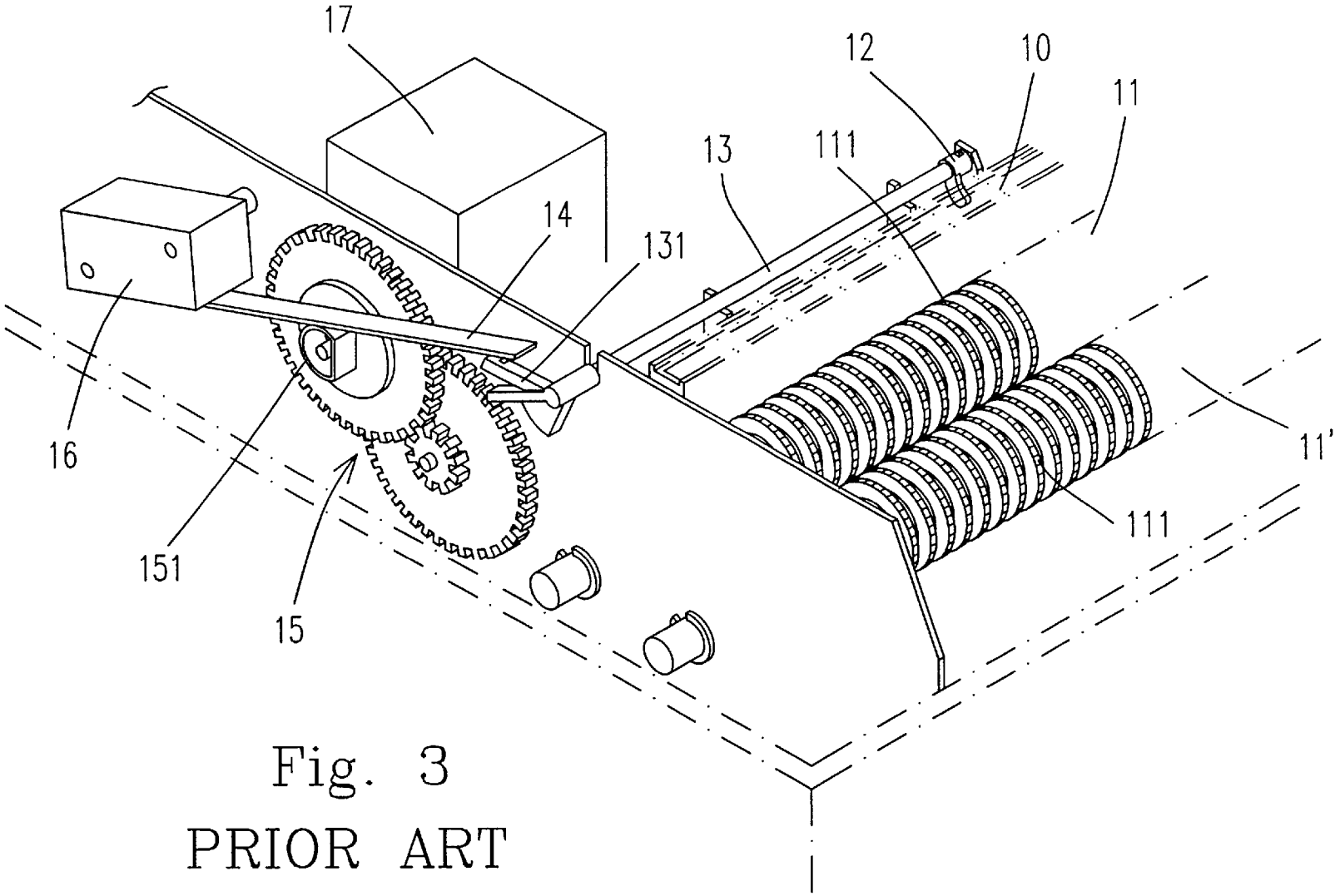
Fig. 3 PRIOR ART
FIG. 3 schematically shows an automatic start mechanism conventionally used in the shredding machine of FIG. 2.
Figure 4:
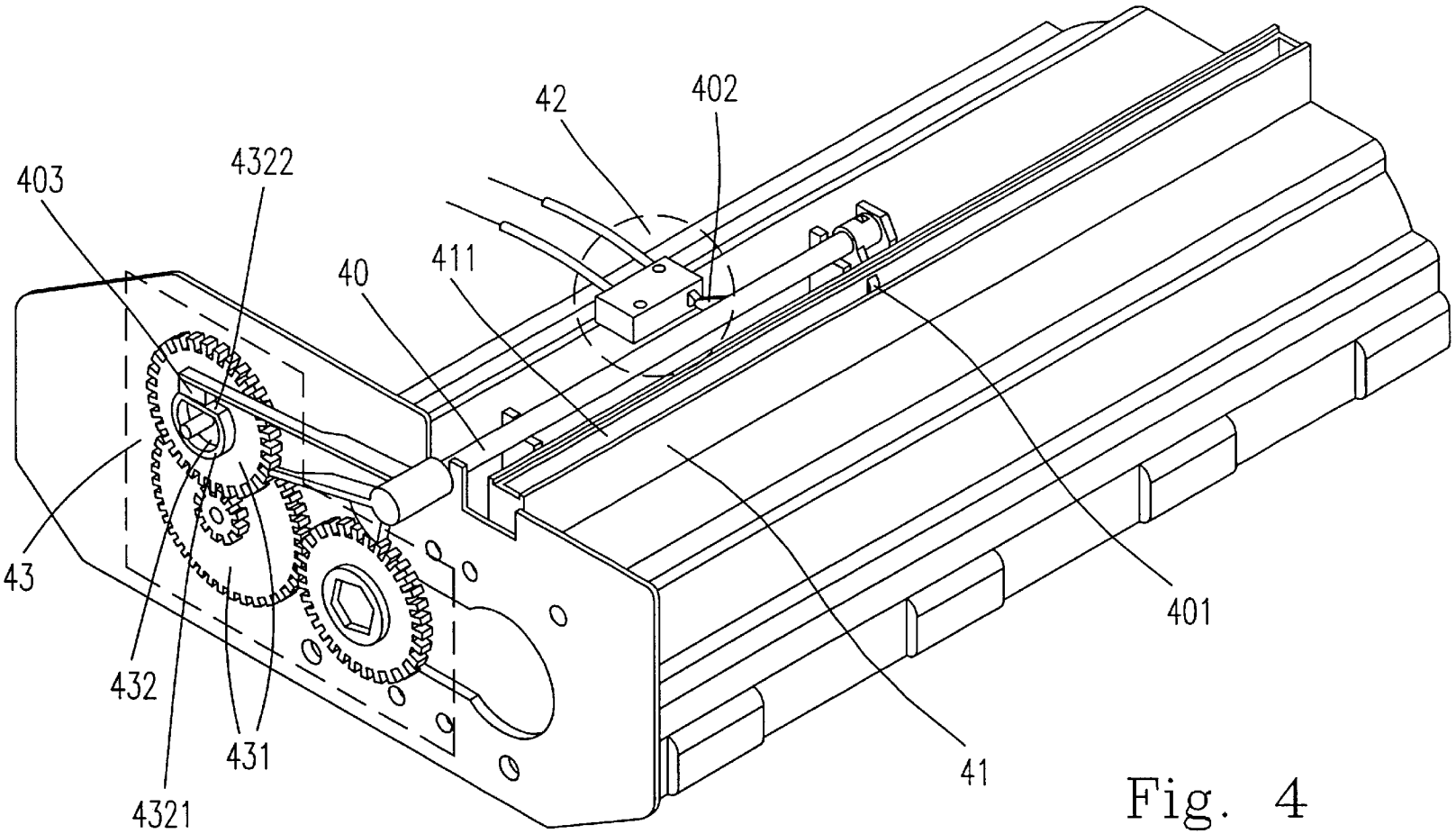
FIG. 4 is a perspective diagram illustrating partial structures of a preferred embodiment of an automatically starting shredding apparatus according to the present invention.

FIG. 4 illustrates partial structures of an automatic start mechanism of a shredding apparatus according to a preferred embodiment of the present invention. The main body of the shredding mechanism includes a first shaft, a second shaft, a plurality of cutters and a plurality of guiding plates and a power source similar to those of the prior art shown in FIG. 2. Therefore, the detailed description relevant to that structure portion is omitted herein. Please now refer to FIG. 4 which illustrates the automatic start mechanism portion in details. In this embodiment, a protruding piece 401 fixed on a lever 40 is used as a trigger, and is disposed at an entrance 411 of a channel 41. The protruding piece 401 is against by paper (not shown) when the paper enters into the channel 41 to carry the lever 40 to rotate. The lever 40 includes a protrusion 402. Thus, when the lever 40 is carried to rotate, the protrusion 402 is against a switch 42, which is electrically connected to a motor (not shown), to turn the switch 42 on. After the switch 42 is switched to an ON condition, the motor is started to carry the cutters to cut the paper.

After the whole paper passes the protruding piece 401, the protruding piece 401 is no longer against by the passing paper. However, the protrusion 402 is still against the switch 42 by a delay unit 43 to keep the switch 42 under the ON condition, wherein the delay unit 43 includes a delay gear set 431 and a delay cam 432. The delay gear set 431 is connected to the motor and carried by the motor to rotate for further carrying the delay cam 432 to rotate. When the delay cam 432 is carried to rotate by the delay gear set 431, the arc portion 4321 of the delay cam 432 is continuously against a portion 403 of the lever 40 for delaying a sustaining force imposed on the switch 42. When the delay cam 432 rotates for a particular time, the portion 403 of the lever 40 is in contact with the flat portion 4322 of the delay cam 432. Then, the against force provided to be against the switch 42 breaks off immediately after the flat portion 4322 of the delay cam 432 no longer keeps the portion 403 of the lever 40 lifted up. Hence, the switch 42 is turned off and returns to an off-circuit condition so as to stop the motor. Therefore, it can be assured that the motor is stopped after the whole paper is fully cut.

According to the present invention, the distance of the protrusion 402 and the trigger, i.e. the protruding piece 401, is smaller than that of the delay unit 43 and the protruding piece 401. In other words, the trigger approaches to the switch to an extent. Hence, the deformation effect of the lever 40 on the lifting range of the portion 403 is reduced. Even though the lever 40 is deformed, the problem resulting from the insufficient lifting range of the portion 403 of the lever 40 can be efficiently solved. Thus, the automatic start function of the shredding apparatus according to the present invention will not be significantly affected and can normally operate.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A shredding apparatus, comprising:

a channel for a paper to enter said shredding apparatus;

a shredding mechanism for cutting said paper when said paper passes through said channel;

a power source for providing a motive power for said shredding mechanism;

a trigger disposed in said channel for arising a move in response to a sustaining force of said paper against said trigger;

a delay unit driven by said power source for delaying said sustaining force for a particular time;

a lever connected between said trigger and said delay unit and carried by said trigger to rotate and carried by said delay unit for delaying said sustaining force; and a switch electrically connected to said power source and optionally connected to a first portion of said lever depending on a moving status of said lever to be switched between an ON condition and an OFF condition, wherein a distance between said first portion of said lever and said trigger is smaller than a distance between said delay unit and said trigger.

2. The shredding apparatus according to claim 1 wherein said power source is an electric motor.

3. The shredding apparatus according to claim 1 wherein said shredding mechanism comprises:

a first shaft carried to rotate by said power source;

a second shaft disposed with said first shaft in parallel and carried to rotate by said power source;

a plurality of cutters staggeredly sleeved and fixed on said first and second shafts and transmitted to rotate by said first and second shaft, respectively, for cutting said paper when said paper passes through said channel, wherein a space is existent between every two adjacent cutters on the same shaft; and a plurality of guiding plates, each of which is disposed in one said space, and movably sleeved on one of said first and said second shafts.

4. The shredding apparatus according to claim 1 wherein said channel includes an entrance end for putting said paper thereinto.

5. The shredding apparatus according to claim 4 wherein said trigger includes a protruding element fixed on said lever, disposed at said entrance of said channel, and against by said paper when said paper passes through said channel to carry said lever to rotate.

6. The shredding apparatus according to claim 1 wherein said delay unit comprises:

a delay gear set connected to said power source and carried by said power source to rotate; and a delay cam connected to said delay gear set and said lever and carried by said delay gear set to rotate for delaying said sustaining force for said particular time.

7. The shredding apparatus according to claim 1 wherein said first portion of said lever is a protrusion optionally connected with said switch for switching said switch between said ON condition and OFF condition depending on a connection status between said protrusion and said switch.

* * * * *